US008606156B2

(12) United States Patent
Watanabe

(10) Patent No.: US 8,606,156 B2
(45) Date of Patent: Dec. 10, 2013

(54) FIXING UNIT AND IMAGE FORMING APPARATUS USING FIXING UNIT

(75) Inventor: Masahiro Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 311 days.

(21) Appl. No.: 13/064,212

(22) Filed: Mar. 11, 2011

(65) Prior Publication Data

US 2011/0229224 A1 Sep. 22, 2011

(30) Foreign Application Priority Data

Mar. 18, 2010 (JP) ..... 2010-062534
Nov. 30, 2010 (JP) ..... 2010-267561

(51) Int. Cl.
*G03G 15/20* (2006.01)

(52) U.S. Cl.
USPC ..... 399/327; 399/122; 399/326; 399/352

(58) Field of Classification Search
USPC ..... 399/122, 326, 327, 352
See application file for complete search history.

(56) References Cited

U.S. PATENT DOCUMENTS

| | | | | |
|---|---|---|---|---|
| 7,058,348 | B2 * | 6/2006 | Aslam et al. | 399/324 |
| 2008/0124144 | A1 | 5/2008 | Mukai et al. | |
| 2010/0232846 | A1 | 9/2010 | Watanabe | |
| 2011/0188904 | A1 * | 8/2011 | Kageyama et al. | 399/327 |

FOREIGN PATENT DOCUMENTS

| | | |
|---|---|---|
| JP | 2000321914 | 11/2000 |
| JP | 2003167465 | 6/2003 |
| JP | 2008304714 | 12/2008 |
| JP | 4266027 | 2/2009 |
| JP | 2009037078 | 2/2009 |

* cited by examiner

*Primary Examiner* — Ryan Walsh
(74) *Attorney, Agent, or Firm* — Harness, Dickey & Pierce, P.L.C.

(57) ABSTRACT

Disclosed is a fixing unit including a fixing member; a pressure member brought into press-contact with a front surface of the fixing member; a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller. The contact roller is caused to move following a movement of the pressure mechanism to maintain a constant contact position, a constant contact direction, and a constant contact force thereof with respect to the pressure member.

21 Claims, 20 Drawing Sheets

FIXING UNIT AND IMAGE FORMING APPARATUS USING FIXING UNIT

BACKGROUND OF THE INVENTION

1. Field of the Invention

The present invention relates to a fixing unit and an electrophotographic image forming apparatus using the fixing unit, such as a copier, a printer, a facsimile machine, and a multi-task machine having plural such functions.

2. Description of the Related Art

As a mainstream technique for fixing toner onto a recording medium, a fixing unit using heat and pressure causes a pressure member to be brought into press-contact with a fixing member including a heat source and then causes a transfer sheet having an unfixed toner image thereon to pass through an area between the fixing member and the pressure member.

The fixing member is subjected to treatment, such as fluorine coating, for preventing its front surface from having toner attached. However, a so-called offset phenomenon, in which toner on a recording medium is slightly attached to the fixing member, may occur depending on environment and conditions on the recording medium. It is known that the offset toner remains on the fixing member and the pressure member contacting the fixing member and is finally reversely transferred onto the recording medium to cause disturbances in an image. To prevent this problem, the fixing member is provided with a cleaning member such as a cleaning web and a cleaning roller. The cleaning member is brought into press-contact with the fixing member and the pressure member to collect the offset toner.

Some of the fixing units like the one described above have the function of causing a pressure member to be moved relative to a fixing member to be brought into press-contact with the fixing member, reduce pressure between the pressure member and the fixing member, and separate the pressure member and the fixing member from each other. Further, it is known that this function is directed to prevent the degradation of the fixing member and the pressure member or used to separate, when the fixing unit is not used, the fixing member and the pressure member from each other so as not to put a load on the members and to cool only the pressure member. Further, other fixing units may have the function of establishing plural positional relationships between a pressure member and a fixing member such as a strong press-contact state and a weak press-contact state when the pressure member is brought into press-contact with the fixing member. It is known that this function is used to produce an optimum press-contact state between the pressure member and the fixing member depending on environment and conditions on a recording medium.

To perform a constant cleaning function at any positional relationship between the pressure member and the fixing member when the cleaning member is brought into contact with the movable pressure member, it is preferable that the cleaning member be brought into contact with the pressure member at a prescribed contact position, at a prescribed contact angle, and with a prescribed contact force. If a distance between a contact roller and the pressure member becomes large and the contact force of a cleaning web becomes too weak, the cleaning function cannot be satisfactorily performed, which results in disturbances in an image.

Further, if the distance between the contact roller and the pressure member becomes small and the contact force becomes too strong, there is a likelihood of a normal correction of toner with the cleaning web being hindered due to the degradation of the materials of the contact roller and the pressure member and an increase in a torque required for winding the cleaning web.

Further, there is no problem with the cleaning member being completely fixed with respect to the fixing unit if the moving amount of the pressure member is substantially small at the contact position of the cleaning member. However, if the pressure member is separated from the fixing member, its moving amount becomes large, which may cause cleaned-up toner to be scattered and retransferred onto a recording medium.

Further, if the cleaning member is a cleaning web, a positional relationship between the shafts of a cleaning web member that contacts the pressure member, a winding roller that collects a used cleaning web, and a supply roller that supplies a new cleaning web may be broken with the movement of the pressure member. This results in the cleaning web having slack, which may hinder a normal collection of a used cleaning web. To prevent this problem, it has been known to use a method for moving a cleaning web following the movement of a pressure member.

The above method, however, requires a user to manually remove a recording medium if a jam occurs after the recording medium has passed through a nip. On this occasion, the pressure member may be driven in a direction opposite to its original driving direction (i.e., rotation a roller and reverse traveling of a belt) depending on how the recording medium is removed. Consequently, the cleaning web excessively wound off the supply roller has great slack at a cleaning nip formed when the cleaning member contacts the pressure member. If the cleaning web has great slack to the extent that a normal winding operation of the cleaning web cannot be performed, a cleaning failure occurs, with the result that an abnormal image may be formed on a recording medium due to black spots, escaping of toner, or the like, and the feeding of sheets may be disabled since the slack web reaches a fixing nip.

As a countermeasure for this problem in terms of control, it has been known to use a method for feeding a next sheet after the cleaning web is wound by a certain amount following a jam. However, since this method causes a user to be on standby for a time required to wind the cleaning web by a certain amount and unnecessarily consumes the cleaning web, the service life of the cleaning web is reduced.

Further, as a countermeasure for this problem in terms of a mechanical configuration, it has been known to use a technique disclosed in Patent Document 3 for preventing a cleaning web from having slack. This technique has a mechanism for controlling the intensity of the contact force of a contact roller or the contact/separation thereof and is aimed at realizing an optimum cleaning function according to use situations. In the case of applying this mechanism as a countermeasure for the above problem, the contact roller separating from a pressure member with which the contact roller is brought into contact at the time of processing the jam described above eliminates concern about an excessive winding of the cleaning web from a supply roller even if the pressure member is driven in any direction. However, this method not only increases a manufacturing cost by an amount corresponding to the mechanism allowing for controlling the intensity of the contact force of the contact roller and the contact/separation thereof but also results in complicated control. Further, there is a case in which toner on a recording medium may be unfixed when a jam is caused in a fixing unit. Therefore, it is necessary to assume a case in which the toner enters a cleaning nip. Moreover, there is a case in which the toner is solidified between the cleaning web and the pressure member if the entered toner is in a semi-molten state to bond the cleaning web and the pressure member together. Therefore, even if the contact roller is separated from the pressure member, the cleaning web is pulled by a bonding part between the contact roller and the pressure member, which results in the cleaning web being wound off the supply roller.

Further, it has been known to use a mechanism for using a driving source for collecting a used cleaning web and supplying a new cleaning web. However, since a cleaning member is a consumable supply and required to be replaced, it is preferable that the number of replacement parts of the cleaning member be minimized in terms of manufacturing cost.

Further, since the fixing unit is at high temperature immediately after its operation, it can be assumed that a cleaning web unit is also at high temperature when being replaced. Accordingly, it is desirable that an operator not replace the cleaning web unit immediately after its operation since the operator may have a risk of being injured such as burning his/her hands. However, the operator is notified of the risk only by an alert message, and thus reliability is lacking. Therefore, it is preferable that fixing unit itself have a safety system as a hardware device.

Patent Document 1: JP-B2-4266027
Patent Document 2: JP-A-2009-037078
Patent Document 3: JP-A-2003-167465
Patent Document 4: JP-A-2000-321914
Patent Document 5: JP-A-2008-304714

SUMMARY OF THE INVENTION

In view of the above problems, the present invention may have an object of providing a fixing unit capable of performing a prescribed cleaning function regardless of the position of a pressure member and having a cleaning web unit that does not cause unnecessary feeding of a web according to a change in the position of the pressure member, and providing an image forming apparatus using the fixing unit.

According to an embodiment of the present invention, there is provided a fixing unit that causes a recording medium to pass through a nip part between a fixing member and a pressure member and applies heat and pressure to the recording medium to fix toner thereon, the fixing unit including the fixing member; the pressure member brought into press-contact with a front surface of the fixing member; a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller. The contact roller of the cleaning web unit is caused to move following a movement of the pressure mechanism to maintain a constant contact position, a constant contact direction, and a constant contact force thereof with respect to the pressure member.

Other objects, features and advantages of the present invention will become more apparent from the following detailed description when read in conjunction with the accompanying drawings.

DETAILED DESCRIPTION OF THE PREFERRED EMBODIMENTS

Hereinafter, embodiments of the present invention are described with reference to the accompanying drawings.

EMBODIMENTS

Figure 14:
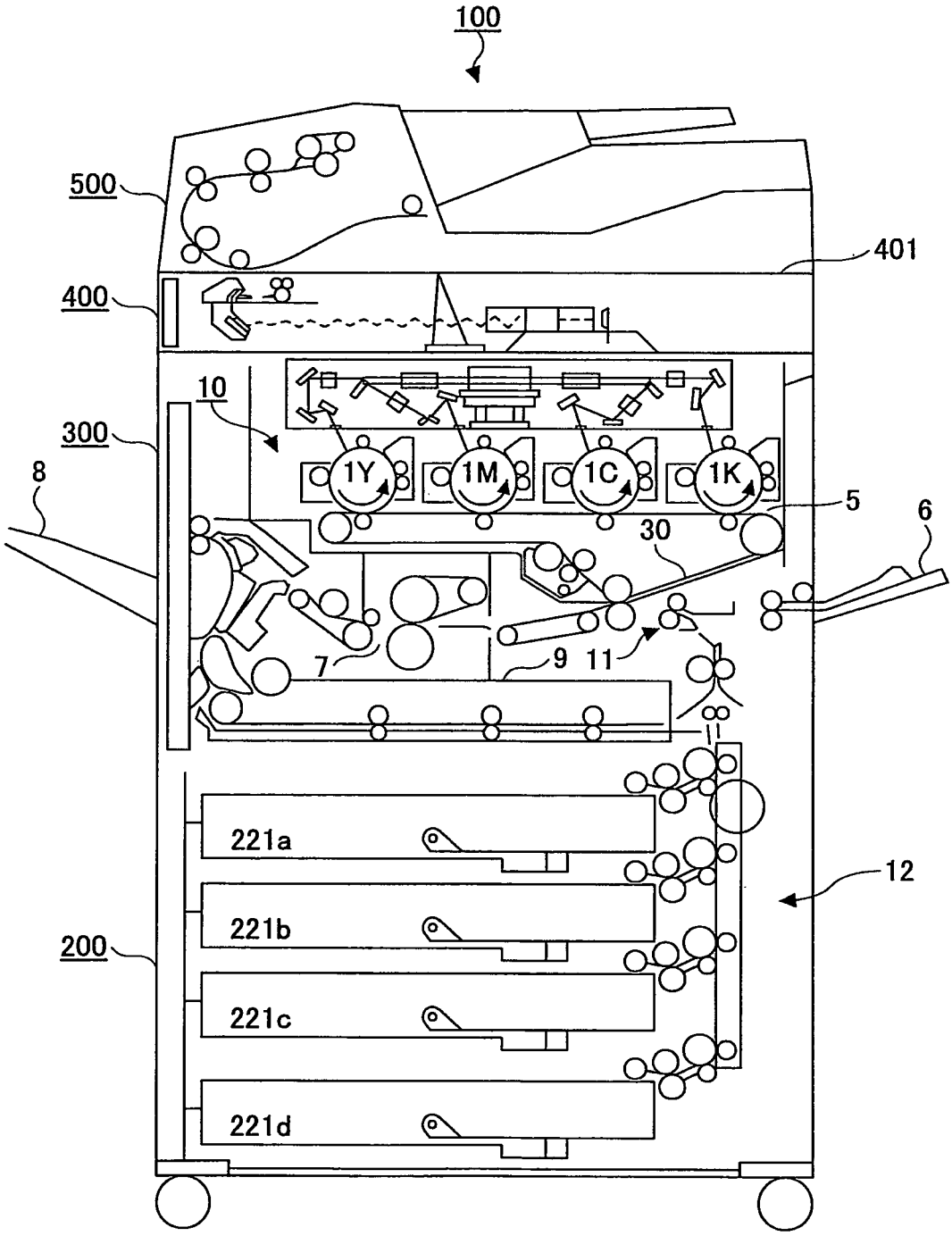
FIG. 14 is a vertical cross-sectional front view schematically showing the entire configuration of a full-color image forming apparatus as an object in which the embodiments of the present invention are carried out.

FIG. 14 is a vertical cross-sectional front view schematically showing the entire configuration of a full-color image forming apparatus as an object in which the embodiments of the present invention are carried out. An image forming apparatus 100 of the embodiments is a tandem-type (parallel-arrangement-type) full-color image forming apparatus using an electrophotographic system. The image forming apparatus 100 has an image forming section (printer engine) 300 acting as an image forming unit at the central part of an apparatus main body and has a sheet feeding section 200 acting as a sheet feeding unit right below the image forming section 300. The sheet feeding section 200 has, for example, four-column sheet feeding cassettes 21*a* through 21*d* each acting as a sheet storage section. These sheet feeding cassettes 21*a* through 21*d* are provided in a manner capable of being freely extracted and inserted in a back-and-forth direction (in the front/rear direction of the space of FIG. 14) with respect to the apparatus main body of the image forming apparatus 100. Further, a scanning section (scanner) 400 that scans a document image is provided above the printer engine 300. Further, a sheet catching tray 8 to which a printed sheet is ejected is provided on the downstream side (at the upper left part of the space of FIG. 14) of the sheet conveyance direction of the printer engine 300. Note that a manual sheet feeding tray 6 acting as a sheet storage section through which a sheet is manually fed is provided on the upstream side (at the upper right part of the space of FIG. 14) of the sheet conveyance direction of the printer engine 300.

In the printer engine 300, four image forming units for the colors of yellow (Y), cyan (C), magenta (M), and black (K) are arranged in parallel above an intermediate transfer belt 30 formed of an endless belt constituting a sheet transfer unit 5. In each of the four image forming units, electrophotographic processing members or units such as a charging unit, an optical writing unit, a development unit, and a cleaning unit are arranged along the periphery of corresponding one of drum-like photosensitive bodies 1Y, 1M, 1C, and 1K provided for the respective colors.

Although not specifically shown in FIG. 14, the charging units perform charging processing on the front surfaces of the photosensitive bodies 1Y, 1M, 1C, and 1K, and the optical writing units irradiate the front surfaces of photosensitive bodies 1Y, 1M, 1C, and 1K with laser beams as image information. The development units visualize electrostatic latent images exposed and formed on the front surfaces of the photosensitive bodies 1Y, 1M, 1C, and 1K into images, and then the cleaning units eliminate and collect toner or the like remaining on the front surfaces of the photosensitive bodies 1Y, 1M, 1C, and 1K after the transfer of the images. After that, the images of the respective colors are successively formed on the intermediate transfer belt 30 and then overlapped one on another to form a single color image. At this time, Y (yellow) toner is first developed by the Y (yellow) image forming unit and transferred onto the intermediate transfer belt 30. Next, C (cyan) toner is developed by the C (cyan) image forming unit and transferred onto the intermediate transfer belt 30. Then, M (magenta) toner is developed by the M (magenta) image forming unit and transferred onto the intermediate transfer belt 30. Finally, K (black) toner is developed by the K (black) image forming unit and transferred onto the intermediate transfer belt 30. In the manner described above, the four colors of the toner particles are overlapped one on another to form a full-color toner image. The full-color toner image formed on the intermediate transfer belt 30 is transferred onto a transfer sheet, which is fed from the sheet feeding section 200, by the sheet transfer unit 5, and then fixed onto the transfer sheet by a fixing unit 7. Finally, the transfer sheet is ejected to the sheet catching tray 8 by a sheet ejecting roller. Meanwhile, after the full-color toner image is transferred onto the transfer sheet, toner or the like remaining on the front surface of the intermediate transfer belt 30 is eliminated and collected by a belt cleaning unit.

The sheet feeding section 200 is composed of the four-column sheet feeding cassettes 221*a* through 221*d* in which transfer sheets installed by a user are stuck and held. The user may set the sizes and types of the sheets installed in the sheet feeding cassettes 221*a* through 221*d* by himself or herself. Further, the sheet feeding section 200 may have a unit that automatically sets conditions for installing the sheets in the sheet feeding cassettes 221*a* through 221*d* by automatically determining the types and thicknesses of the sheets according to the positions of side fences that align the transfer sheets with each other inside the sheet feeding cassettes 221*a* through 221*d* and measurement devices that measure the resistance of the stuck sheets. The sheet feeding cassettes 221*a* through 221*d*, the manual sheet feeding tray 6, and a pair of resist rollers 11 are connected to each other by a conveyance path 12. The transfer sheet fed from any sheet feeding place is conveyed to the pair of resist rollers 11 via the conveyance path 12. The pair of resist rollers 11 temporarily stops the conveyance of the transfer sheet and then feeds the same to a sheet transfer section at a timing at which a given positional relationship can be established between a toner image on the intermediate transfer belt 30 and the tip end of the transfer sheet. The pair of resist rollers also performs the same function as the above on the transfer sheet fed from the manual sheet feeding tray 6.

Although not specifically shown in FIG. 14, plural scanning bodies on which are mounted a document illuminating light source and a mirror reciprocate to scan a document placed on a contact glass 401 in the scanner 400. Image information scanned by the scanning bodies is condensed onto the image forming surface of a CCD by a lens provided on a rear side, and then read as an image signal by the CCD. The read image signal is digitized and subjected to image processing. Based on the image signal subjected to the image processing, optical writing is applied to the front surfaces of the photosensitive bodies by the illumination of laser diodes LD of the optical writing unit to form electrostatic latent images. Optical signals from the laser diodes LD reach the photosensitive bodies via a polygon mirror and lenses. Further, an automatic document feeder 500 that automatically feeds a document onto the contact glass is mounted above the scanner 400.

Figure 1A:
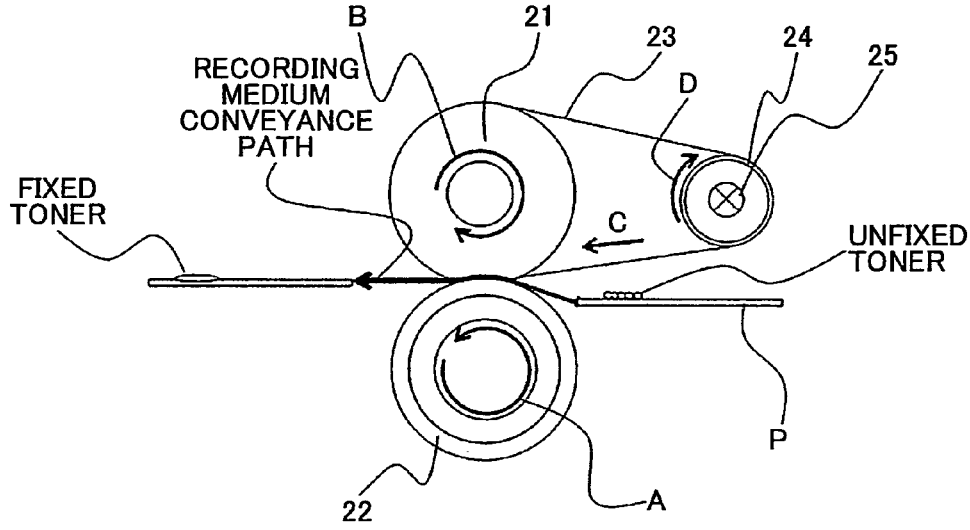
FIG. 1A is a conceptual view showing a basic configuration example of a fixing unit according to embodiments of the present invention.

FIG. 1A is a conceptual view showing a basic configuration example of a fixing unit according to the embodiments of the present invention. The fixing unit shown in FIG. 1A has a fixing belt 23 as an example of an endless fixing member, and the fixing belt 23 is laid and wound on a fixing roller 21 and a heating roller 24. The endless belt may be laid and wound on three or more rollers or silding members. A pressure roller 22 as an example of a pressure member is brought into press-contact with the front surface of the fixing belt 23. In an example shown in FIG. 1A, the pressure roller 22 is brought into press-contact with a part of the fixing belt 23 wound on the fixing roller 21.

The pressure roller 22 is driven to rotate by a motor (not shown) in a direction as indicated by arrow A in FIG. 1A. The rotation of the pressure roller 22 is transmitted to the fixing roller 21 via a gear (not shown), and the fixing roller 21 is driven to rotate in a direction as indicated by arrow B in FIG. 1A. Further, the fixing belt 23 is driven to run in a direction as indicated by arrow C in FIG. 1A with the rotation of the fixing roller 21. Furthermore, the heating roller 24 is driven to rotate in a direction as indicated by arrow D in FIG. 1A with the driving of the fixing belt 23.

As described above, the fixing unit of the embodiments has the endless belt laid and wound on the plural rollers and driven to run. In the example shown in FIG. 1A, the endless belt acts as the fixing belt 23 laid and wound on at least the two rollers of the fixing roller 21 and the heating roller 24, and the pressure member acting as the pressure roller 22 is brought into press-contact with the front surface of the fixing belt 23. As the pressure member, a pressure belt or the like may be used. The heating roller 24 is formed to be hollow, and heaters 25 are arranged in the inner parts of the heating roller 24. The heating roller 24 and the fixing belt 23 are heated by the heaters 25. Alternatively, the pressure roller 22 and the fixing roller 21 may have a hollow shaft and a heater arranged therein so as to be heated. Further, temperature sensors (not shown) are oppositely arranged at a part of the fixing belt 23 in contact with the heating roller 24, a part of the fixing belt 23 in contact with the fixing roller 21, and the pressure roller 22, respectively. Based on temperature detection results by the respective sensors, application of a current to the respective heaters is controlled such that the fixing belt 23 and the pressure roller 22 are set at temperatures suitable for fixing a toner layer. The fixing belt 23 is composed of, for example, a base material made of polyimide, silicon rubber formed on the base material, and a front layer made of a fluorine resin laminated on the front surface of the silicon rubber.

Figure 1B:
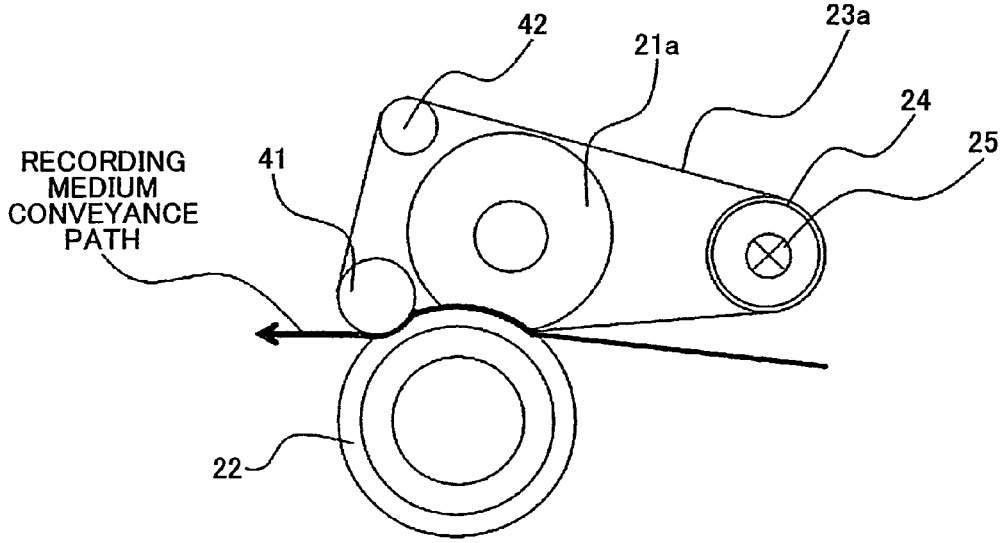
FIG. 1B is a conceptual view showing a modification of the configuration example shown in FIG. 1A.

The fixing unit shown in FIG. 1B shows the configuration of a modification composed of a separation roller 41, a tension roller 42, a fixing roller 21*a*, the heating roller 24, and a fixing belt 23*a* as an example of an endless belt laid and wound on these rollers.

Figure 1C:
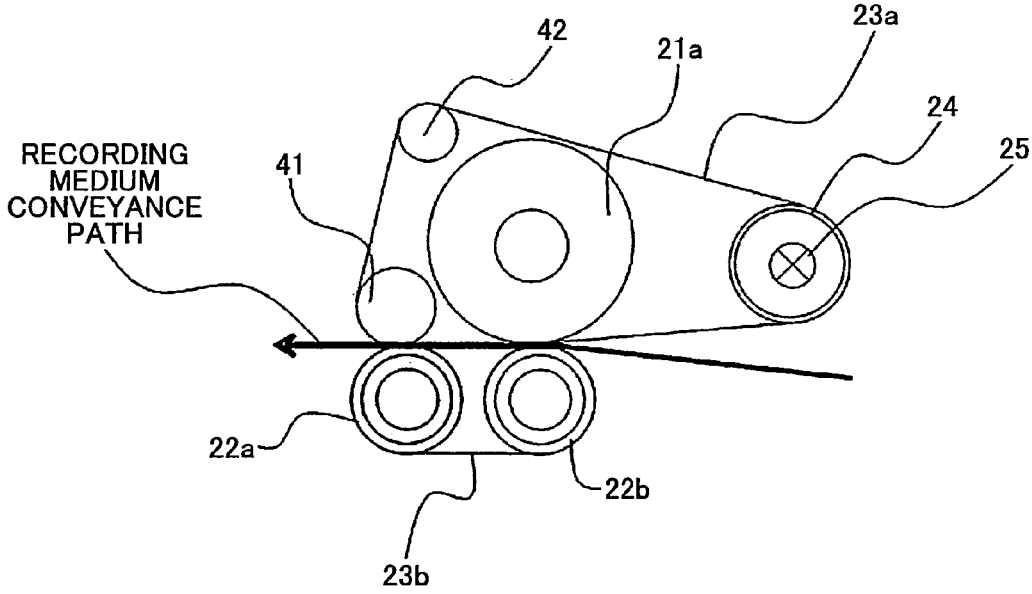
FIG. 1C is a conceptual view showing another modification of the configuration example shown in FIG. 1A.

Further, like one shown in FIG. 1C, the fixing unit may be configured to have the pressure member composed of two pressure rollers 22*a* and 22*b* and an endless fixing belt 23*b* laid and wound on the two pressure rollers.

Figure 1D:
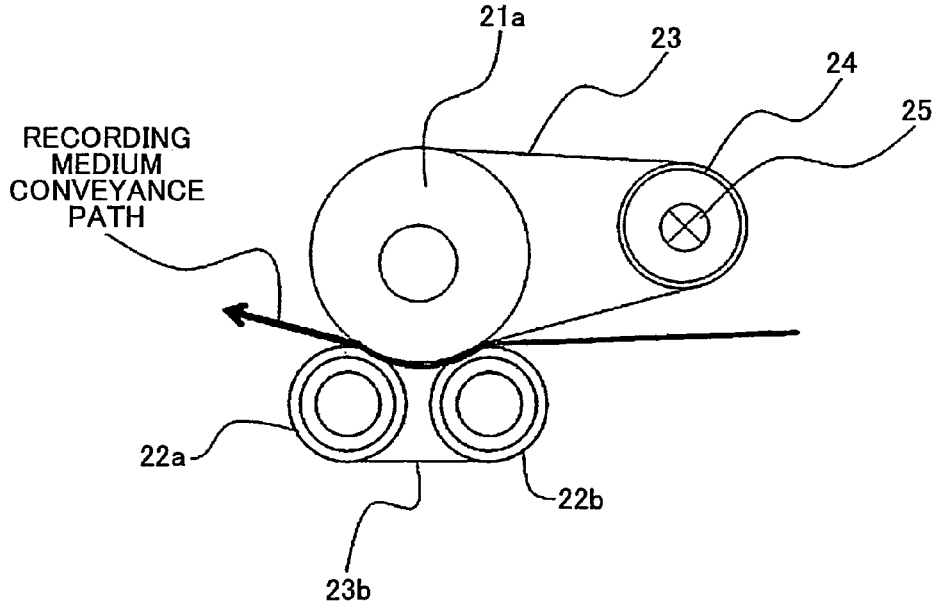
FIG. 1D is a conceptual view showing still another modification of the configuration example shown in FIG. 1A.

Furthermore, like one shown in FIG. 1D, the fixing unit may be configured to have the pressure member shown in FIG. 1C in addition to the fixing member composed of the fixing belt 23 and a fixing roller 21*a* and the heating roller 24 on which the fixing belt 23 is laid and wound.

Figure 1E:
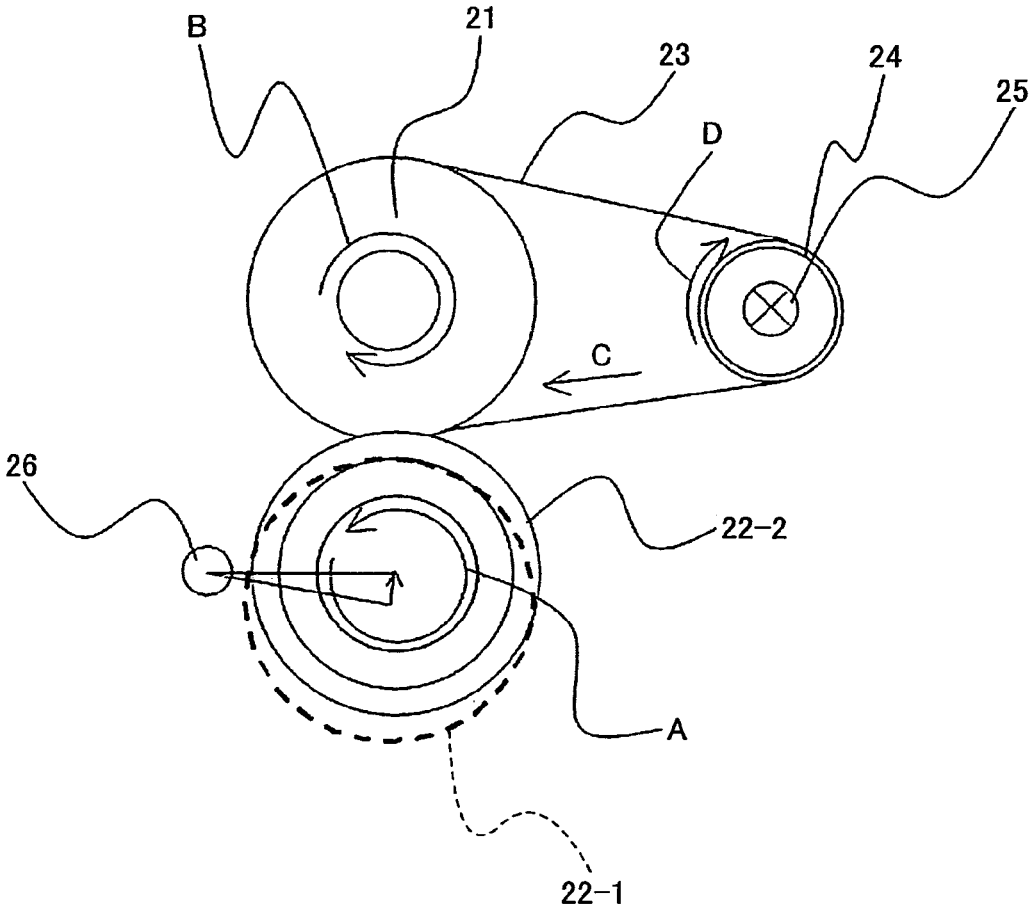
FIG. 1E is a conceptual view showing where the configuration example shown in FIG. 1A reproduces its pressure-reducing state and pressure-increasing state.

According to the configuration of the fixing unit shown in FIG. 1A, the pressure roller 22 can rotate and move about a rotation center shaft 26 as shown in FIG. 1E and arbitrarily reproduce its pressure-reducing state 22-1 and pressure-increasing state 22-2 with a driving unit (not shown). According to the configuration examples of the fixing units shown in FIGS. 1B, 1C, and 1D, the respective pressure members can rotate and move about rotation center shafts (not shown) and arbitrarily reproduce their pressure-increasing states and pressure-reducing states with driving units (not shown).

Figure 1F:
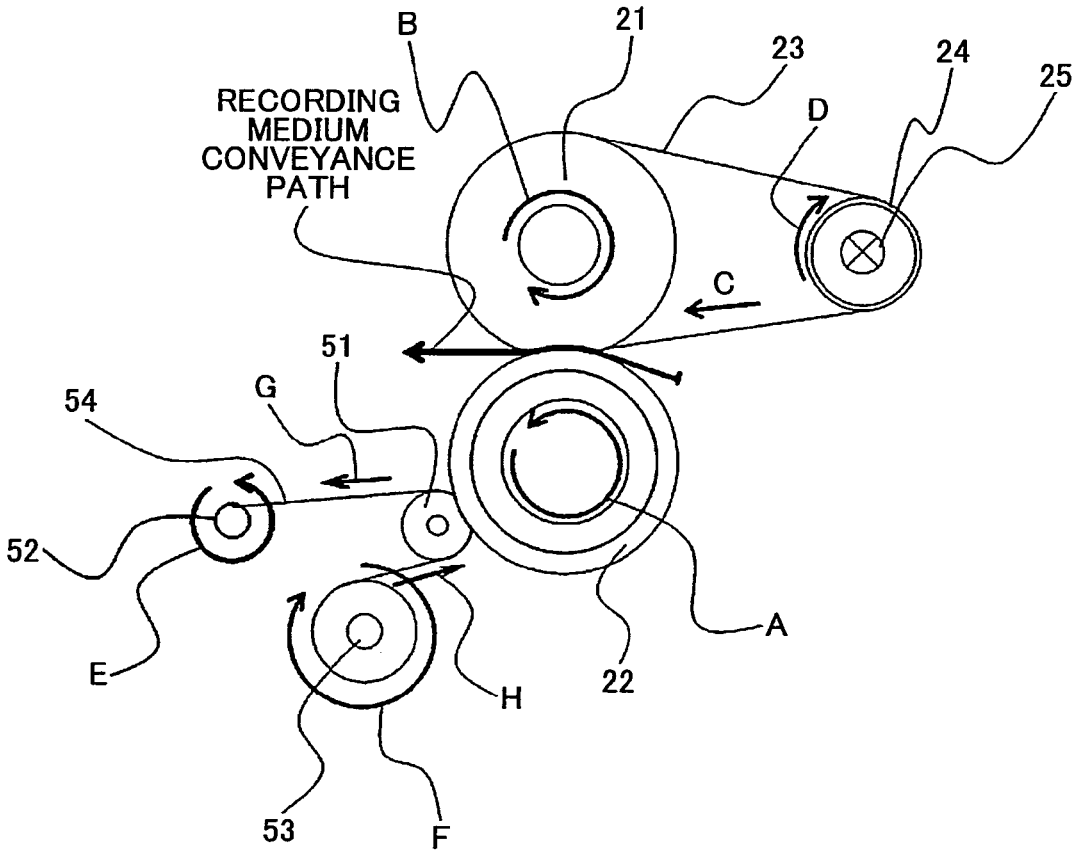
FIG. 1F is a conceptual view showing an example in which a cleaning web unit is applied to the configuration example shown in FIG. 1A.

Furthermore, like one shown in FIG. 1F, the fixing unit may be configured to have a cleaning web unit composed of at least a cleaning web contact roller 51, a cleaning web winding roller 52, a cleaning web supply roller 53, a cleaning web 54, and a driving unit (not shown in FIG. 1F) that drives the cleaning web winding roller 52. The cleaning web unit is arranged with respect to the pressure roller 22 serving as the pressure member. Thus, the fixing unit may be configured to wipe off toner remaining on the pressure roller 22 when the cleaning web 54 is brought into contact with the pressure roller 22 by the cleaning web contact roller 51.

In this example, the used cleaning web 54 having wiped off the toner is wound and collected in a direction as indicated by arrow G when the cleaning web winding roller 52 is driven to rotate in a direction as indicated by arrow E by a driving unit (not shown), while a new cleaning web 54 is wound off in a direction as indicated by arrow H and supplied to a contact part between the contact roller 51 and the pressure roller 22 when the cleaning web supply roller 53 is driven to rotate in a direction as indicated by arrow F. Note that the configuration of the fixing unit shown in FIG. 1F may be those composed of the fixing member and the pressure member as shown in FIGS. 1A, 1C, and 1D.

First Embodiment

Figure 2A:
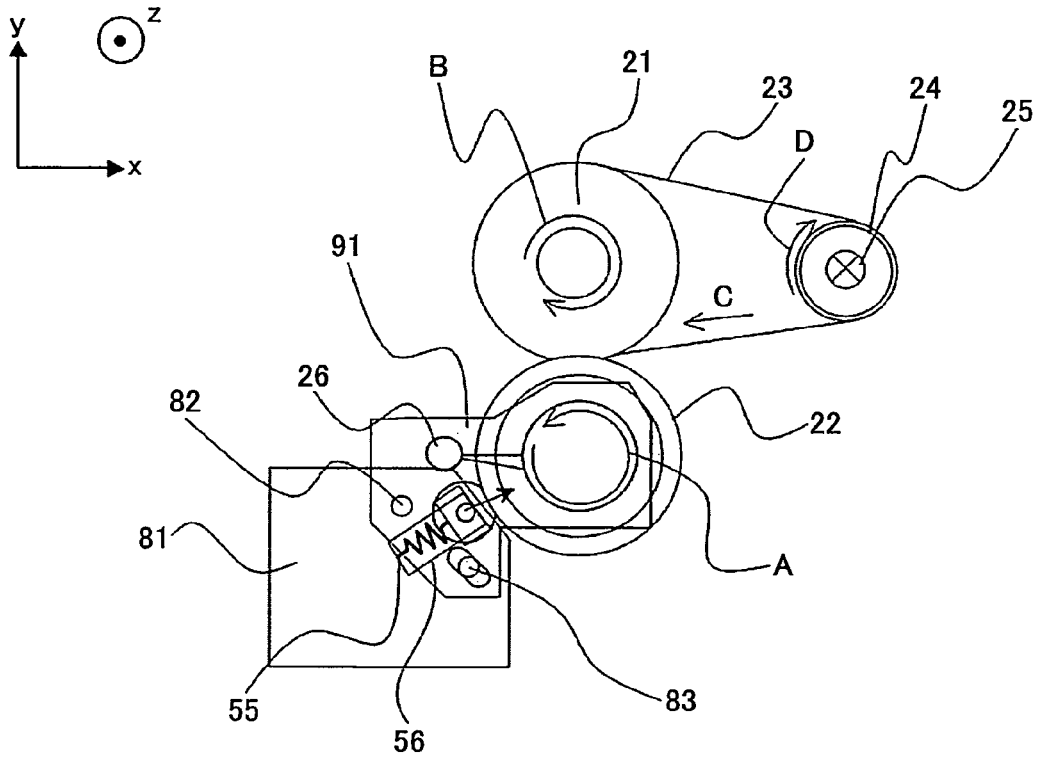
FIG. 2A is a view showing the pressure-increasing state according to a first embodiment of the present invention.
Figure 2B:
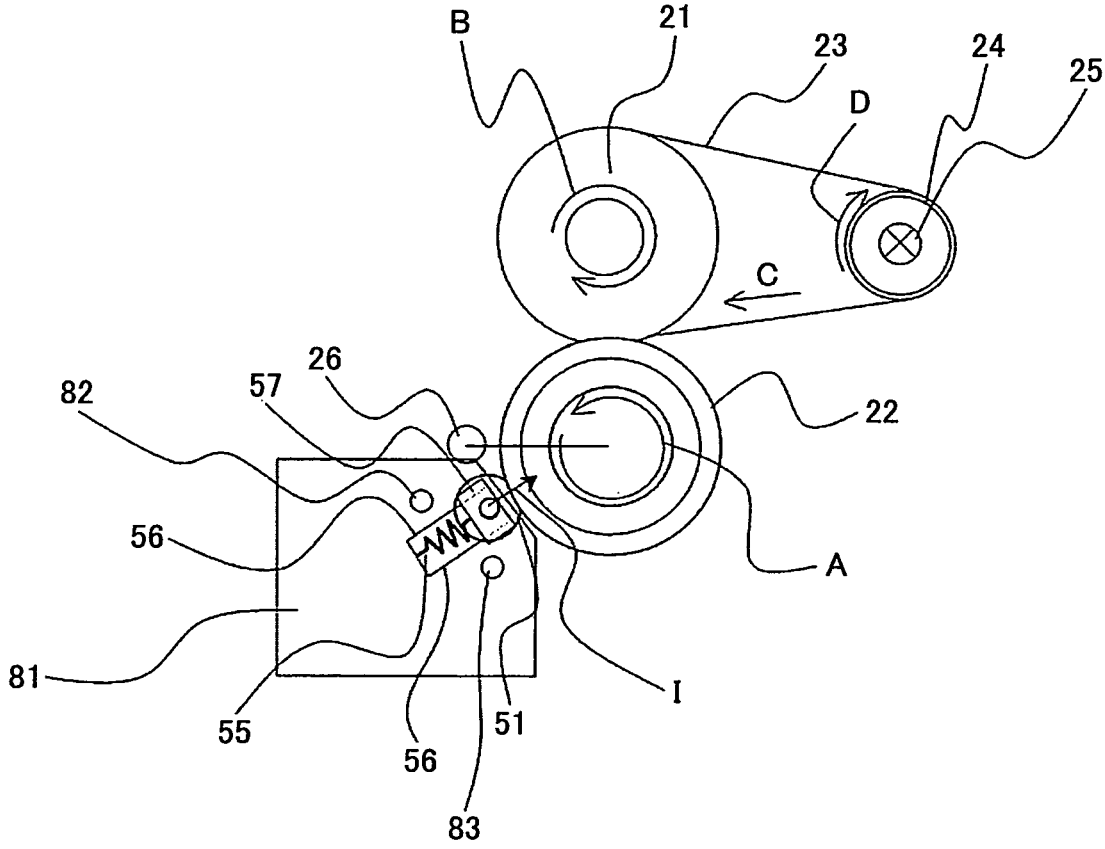
FIG. 2B is a view showing the pressure-increasing state according to the first embodiment of the present invention.
Figure 3:
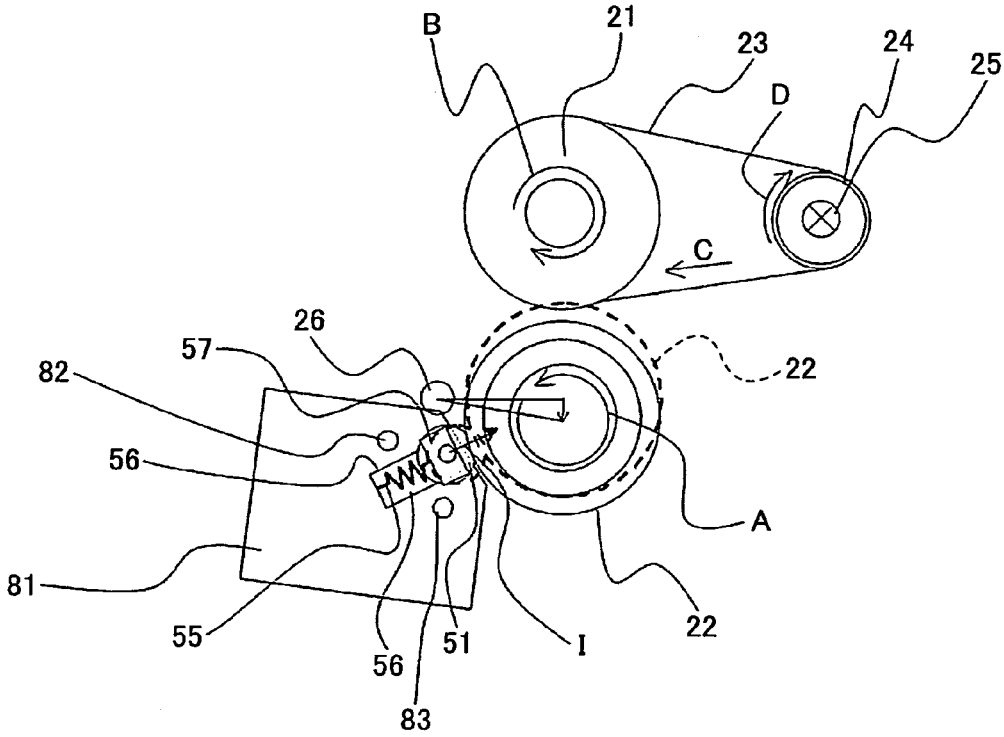
FIG. 3 is a view showing a pressure-reducing state according to the first embodiment of the present invention.

A first embodiment of the present invention is shown in FIGS. 2A, 2B, and 3. In the fixing unit composed of the fixing roller 21, the pressure roller 22, the heating roller 24, the fixing belt 23, and the heaters 25 as described above, the cleaning web unit has a member 81 shown in FIG. 2A and the member 81 has positioning pins 82 and 83 and a square-hole-shaped part 56.

In this fixing unit, a member 91 shown in FIG. 2A is freely rotatable about a rotation shaft 26 fixed inside the fixing unit, has a hole shape for holding the journal part of the pressure roller 22, and is shaped in a manner capable of fixing a distance between the shafts of the pressure roller 22 and the rotation shaft 26. Moreover, the member 91 has a hole-shaped part capable of completely fixing the member 81 in an XY plane when the positioning pins 82 and 83 are inserted.

Moreover, in FIG. 2B showing a modification in which the member 91 shown in FIG. 2A is omitted, the member 81 can hold a slide bearing 57 allowed to move only in a direction parallel to a vector as indicated by arrow I inside the square-hole-shaped part 56. The slide bearing 57 is pressed to the pressure roller 22 by a compression spring 55. On this occasion, the square-hole-shaped part 56 is provided to be parallel to the vector. Therefore, the slide bearing 57 is also pressed only in the direction of the vector.

The slide bearing 57 is configured to support the journal part of the cleaning web contact roller 51 and press the cleaning web contact roller 51 in the direction of the vector, i.e., in the direction of the pressure roller 22.

In such a fixing unit, when the pressure roller 22 performs a pressure-reducing operation and a pressure-increasing operation, e.g., when the pressure roller 22 moves from the pressure-increasing state shown in FIGS. 2A and 2B to the pressure-reducing state shown in FIG. 3, the cleaning web contact roller 51 and the pressure roller 22 move to positions as shown in FIG. 3. In this case, however, the member 91 is only rotated and moved about the rotation shaft 26. Therefore, a positional relationship between the cleaning web contact roller 51 and the pressure roller 22 with respect to the member 91 and the vector of the pressing force of the cleaning web contact roller 51 as viewed from the pressure roller 21 remain the same.

Note that this fixing unit may be replaced by any of the fixing units shown in FIGS. 1B, 1C, and 1D.

Second Embodiment

Figure 4:
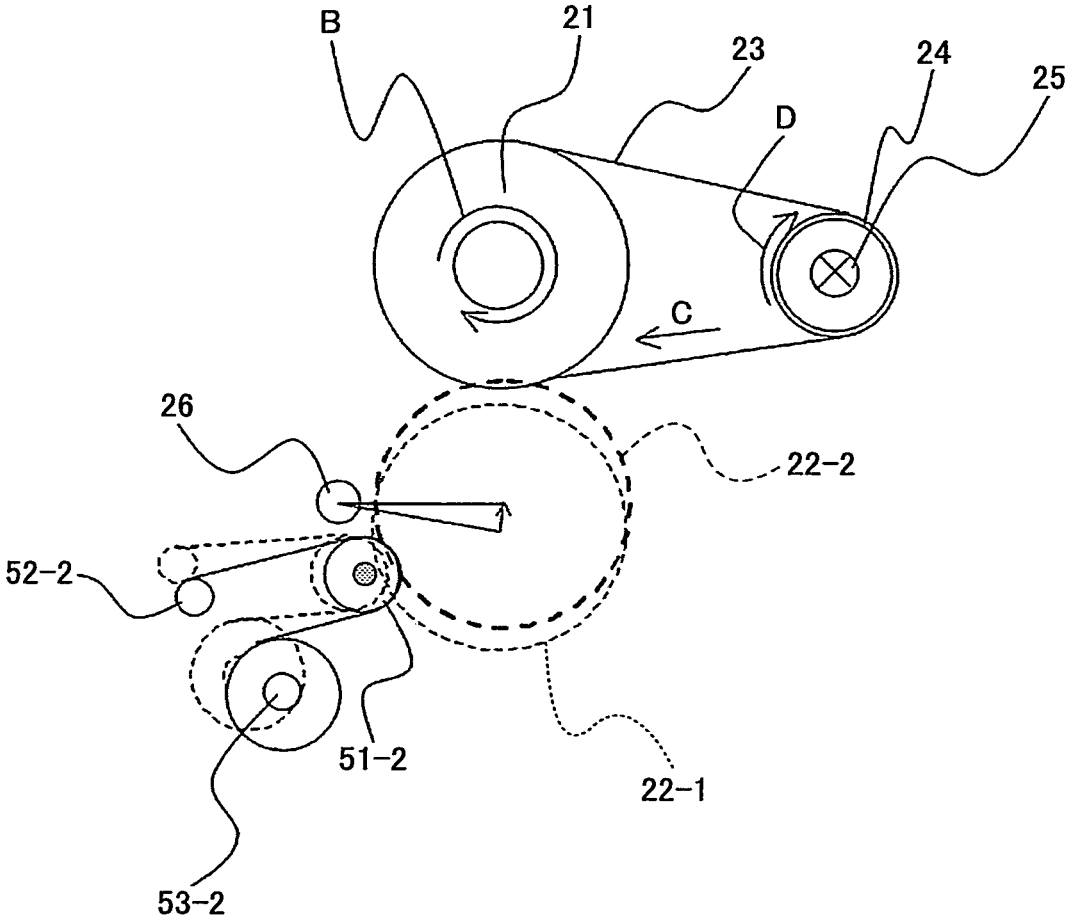
FIG. 4 is a view showing a winding roller and a supply roller in the pressure increasing state according to a second embodiment of the present invention.
Figure 5:
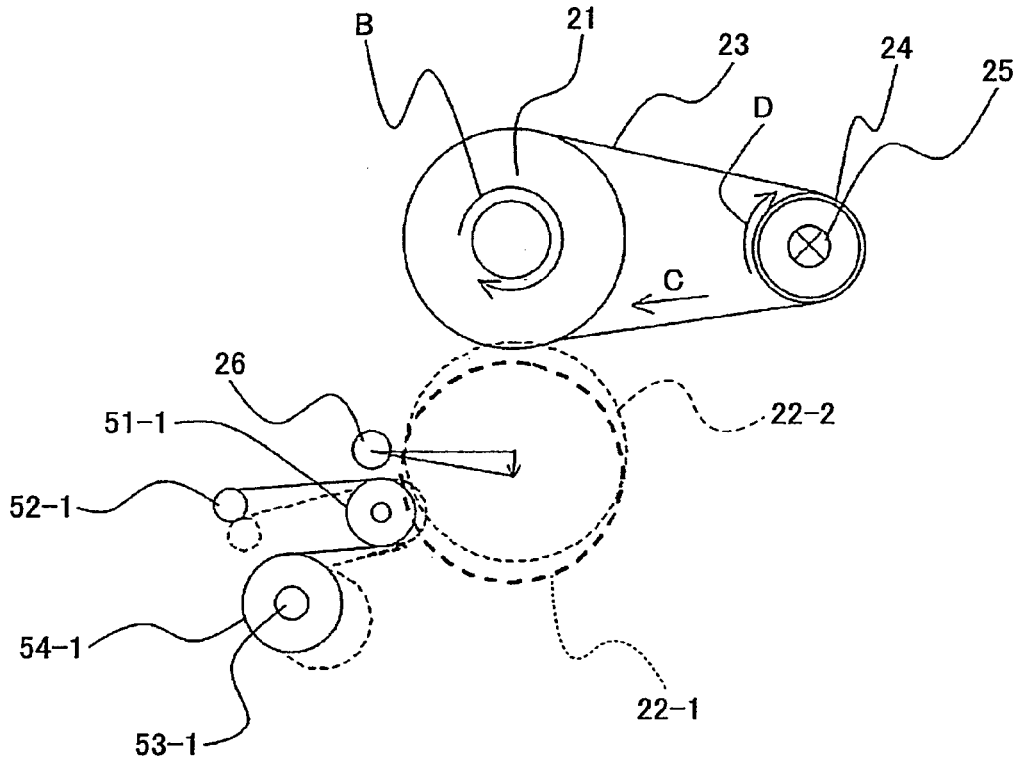
FIG. 5 is a view showing the winding roller and the supply roller in the pressure reducing state according to the second embodiment of the present invention.
Figure 6:
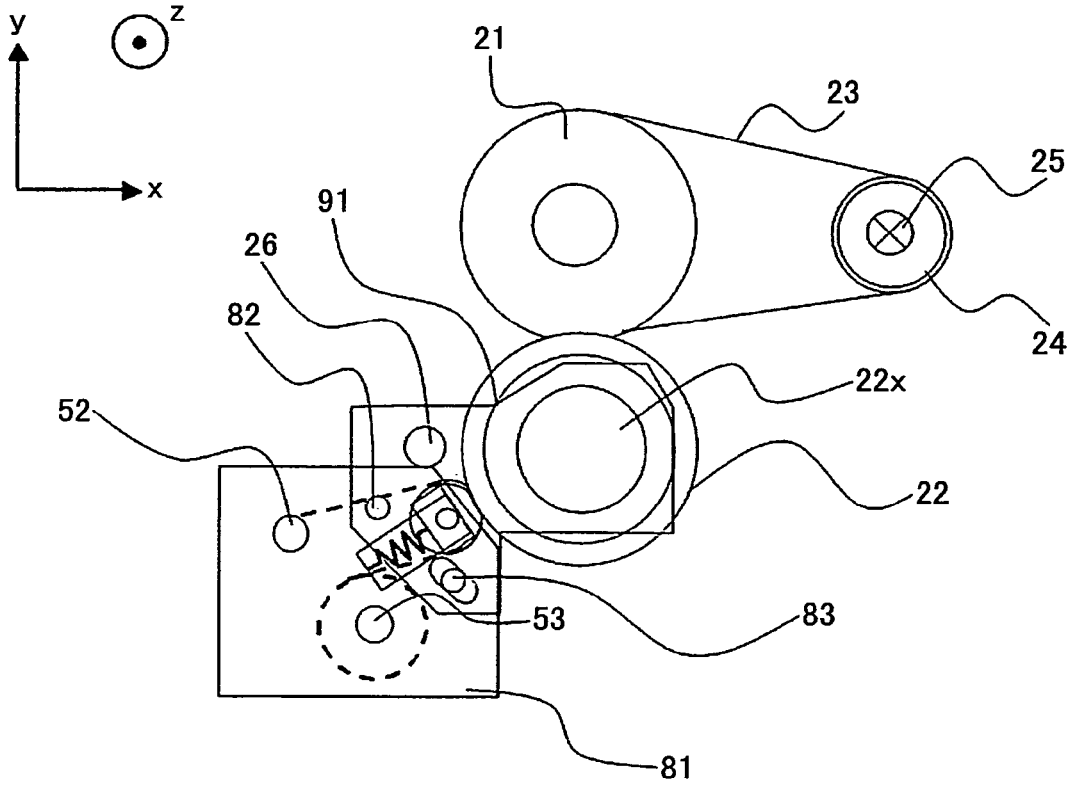
FIG. 6 is a conceptual view showing an example of the fixed cleaning web unit according to the second embodiment of the present invention.

A second embodiment of the present invention is shown in FIGS. 4, 5, and 6. This embodiment is directed to the fixing unit composed of the fixing roller 21, the pressure roller 22, the heating roller 24, the fixing belt 23, the heaters 25, the cleaning web contact roller 51, the cleaning web 54, and the compressing spring 55 acting as a pressure mechanism. As shown in FIGS. 4 and 5, in this fixing unit, a cleaning web winding roller 52-2 and a cleaning web supply roller 53-2 in the pressure-increasing state shown in FIG. 4 and a cleaning web winding roller 52-1 and a cleaning web supply roller 53-1 in the pressure reducing state shown in FIG. 5 are fixed in their positions with respect to the pressure roller 22 regardless of how the pressure roller 22 is arranged. The fixing unit of this embodiment has a mechanism, for example, shown in FIG. 6 such that these rollers move following the pressure roller 22 to maintain a positional relationship between these rollers and the pressure roller 22.

The member 91 shown in FIG. 6 has its shaft fixed in a manner capable of being freely rotated about the rotation shaft 26, and a journal part 22*x* of the pressure roller 22 has its shaft fixed in a manner capable of being rotated. Moreover, the member 81 inside the cleaning web unit has its shaft fixed in a manner capable of being freely rotated with respect to the cleaning web winding roller 52 and the cleaning web supply roller 53, and has the positioning pins 82 and 83 (hereinafter referred to as a main reference pin 82 and a sub-reference pin 83, respectively). When the main reference pin 82 and the sub-reference pin 83 are inserted in the member 81 as shown in FIG. 6, a positional relationship between the member 81 and the member 91 is completely maintained in the XY plane. Accordingly, in the fixing unit, the positional relationship in the XY plane between the pressure roller 22, the cleaning web winding roller 52, and the cleaning web supply roller 53 can be completely maintained.

Note that the fixing unit may be replaced by any of the fixing units shown in FIGS. 1B, 1C, and 1C.

Third Embodiment

Figure 7:
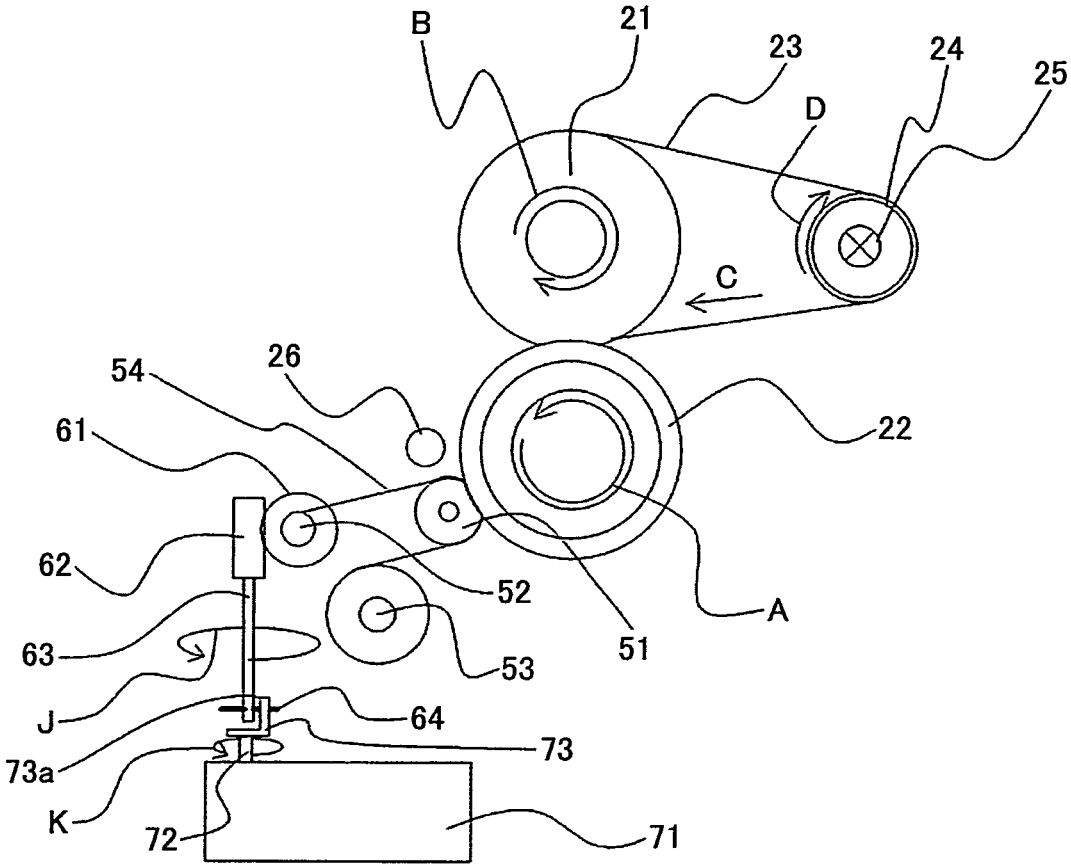
FIG. 7 is a conceptual view showing where the cleaning web unit is attached according to a third embodiment of the present invention.

A third embodiment of the present invention is shown in FIG. 7. This embodiment is directed to the fixing unit composed of the fixing roller 21, the pressure roller 22, the heating roller 24, the fixing belt 23, the heaters 25, the cleaning web contact roller 51, the cleaning web 54, the compression spring 55, the cleaning web winding roller 52, and the cleaning web supply roller 53. In this fixing unit, the cleaning web unit includes a freely-rotatable rotation shaft 63 in which a pin 64 is press-fit, in addition to the cleaning web contact roller 51, the cleaning web 54, the compression spring 55, the cleaning web winding roller 52, and the cleaning web supply roller 53. Further, the rotation shaft 63 has a worm gear 62 inserted and fixed therein. Moreover, a spur gear 61 is inserted and fixed in the cleaning web winding roller 52 to be meshed with the worm gear 62. Thus, the driving of the worm gear 62 can be transmitted to the cleaning web winding roller 52.

Outside the fixing unit, a driving source unit composed of a driving source 71, a driving shaft 72, and a driving transmission part 73 shown in FIG. 7 is arranged. The driving shaft 72 is arranged coaxially with the rotation shaft 63. The driving transmission part 73 has a convex part 73*a*. When the convex part 73*a* is caught in the pin 64, the driving torque of the driving source is transmitted to the rotation shaft 63 in a direction as indicated by arrow K, so that the rotation shaft 63 is driven to rotate in a direction as indicated by arrow J. Then, the driving torque is transmitted to the cleaning web winding roller 52 via the spur gear 61, and the used cleaning web 54 is collected.

The driving transmission part 73 and the pin 64 are dedicated to transmitting the torque in the direction as indicated by arrow K with the catching of the convex part 73*a*. The fixing unit is capable of being separated from the driving source unit at a driving connection part in a direction as indicated by arrow L in FIG. 8.

Figure 9:
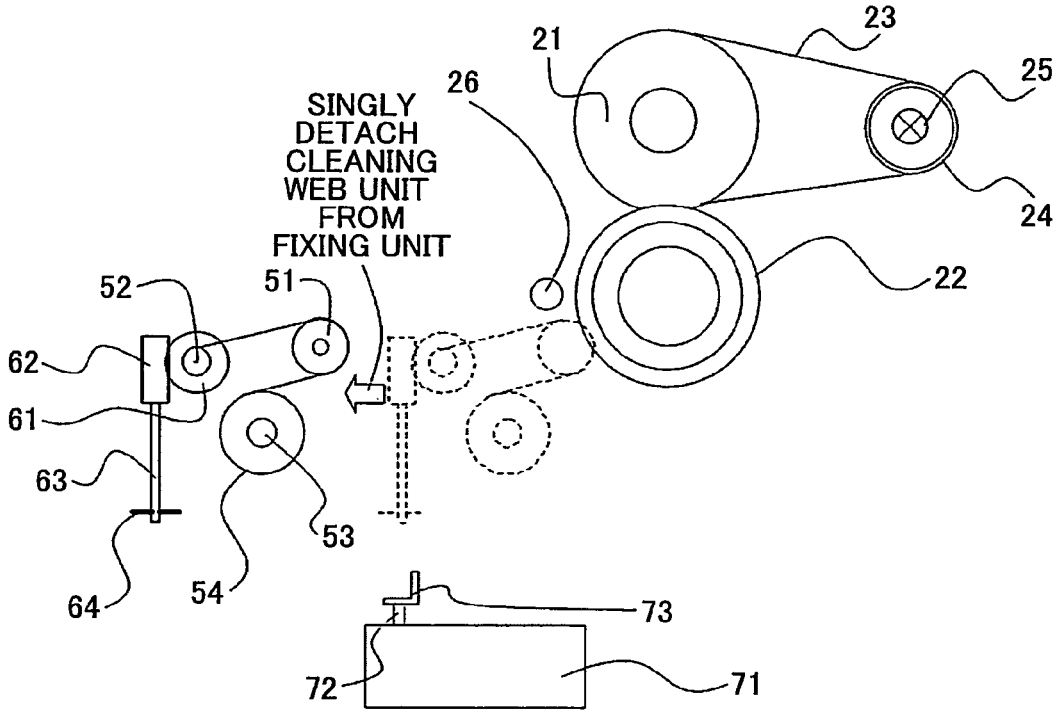
FIG. 9 is a conceptual view showing where the detachment of the cleaning web unit is completed according to the third embodiment of the present invention.

Moreover, the cleaning web unit composed of the cleaning web contact roller 51, the cleaning web 54, the compression spring 55, the cleaning web winding roller 52, and the cleaning web supply roller 53 is singly detachable from the fixing unit by a holding unit (not shown) as shown in dotted lines and solid lines in FIG. 9.

Fourth Embodiment

Figure 10:
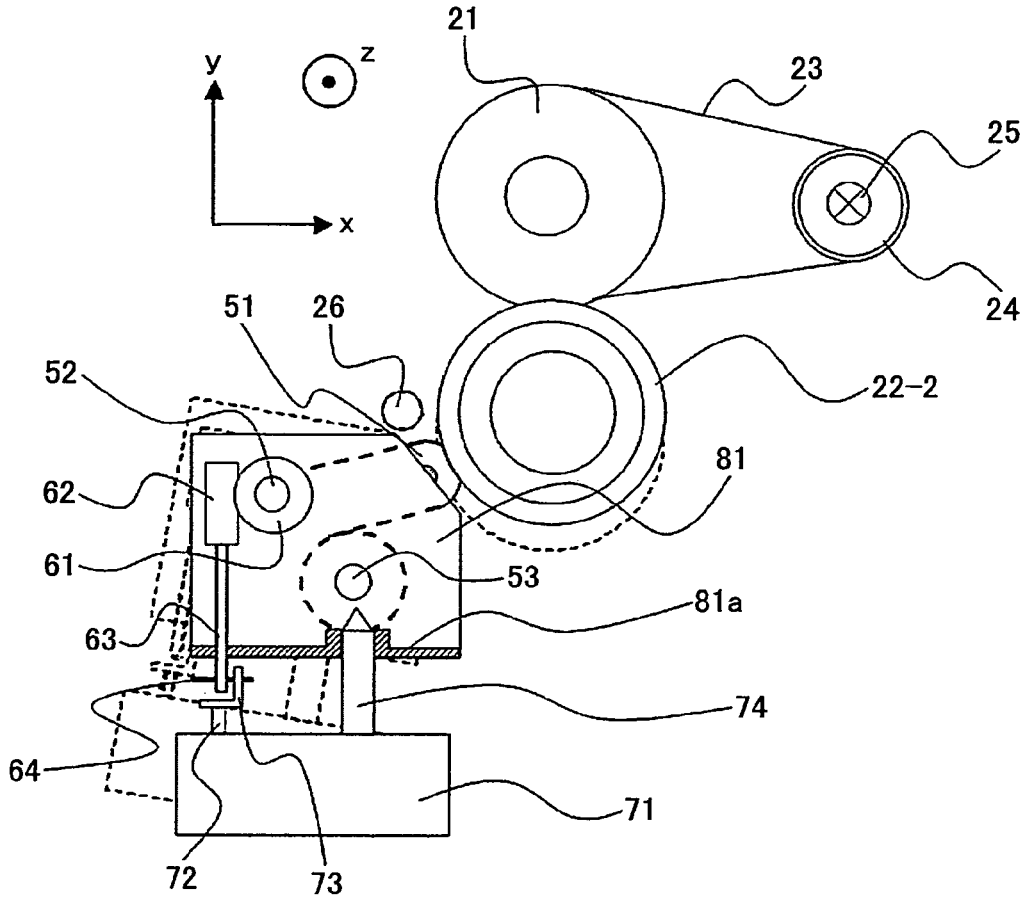
FIG. 10 is a conceptual view showing where the driving source unit for winding a cleaning web is positioned (at the pressure increasing state) according to a fourth embodiment of the present invention.
Figure 11:
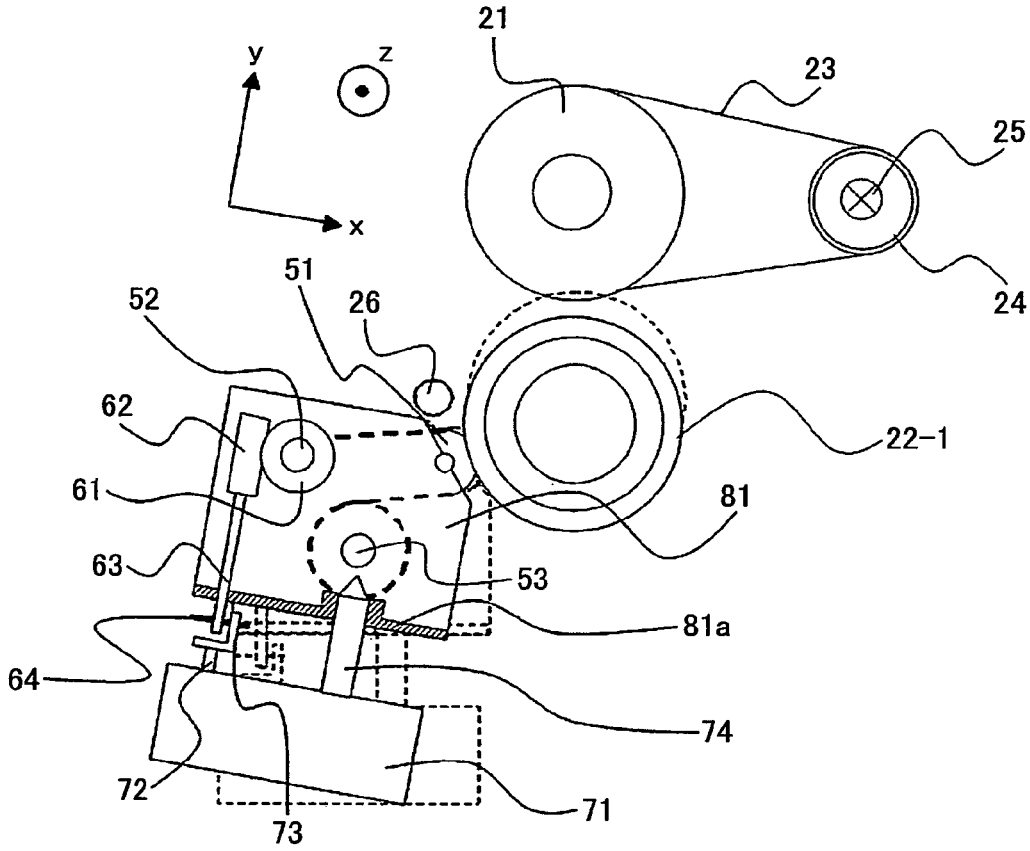
FIG. 11 is a conceptual view showing where the driving source unit for winding the cleaning web is not positioned (at the pressure reducing state) according to the fourth embodiment of the present invention.

A fourth embodiment of the present invention is shown in FIGS. 10 and 11. This embodiment is directed to the fixing unit composed of the fixing roller 21, the pressure roller 22, the heating roller 24, the fixing belt 23, the heaters 25, the cleaning web contact roller 51, the cleaning web 54, the compression spring 55, the cleaning web winding roller 52, and the cleaning web supply roller 53, and directed to the driving source unit provided outside the fixing unit and composed of the driving source 71, the driving shaft 72, and the driving transmission part 73. The driving source unit has a positioning pin 74 as shown in FIGS. 10 and 11, and the cleaning web unit provided in the fixing unit has the member 81. The member 81 is fixed with respect to the shaft positions of the cleaning web winding roller 52 and the cleaning web supply roller 53 in the XY plane of a coordinate system XYZ fixed to the member 81.

Moreover, the member 81 has a cross-sectional shape part 81*a* having a circular hole. When the positioning pin 74 is inserted in the circular hole of the cross-sectional shape part 81*a*, the cleaning web unit and the driving source unit are fixed in their positions about the X-axis direction and the Z-axis direction in the coordinate system XYZ. Further, when the driving source unit is connected to the fixing unit by a detachment and attachment unit (not shown), the driving source unit is coaxially fixed to the rotation center shaft 26 on the fixing unit shown in FIG. 10 and freely rotatable about the rotation center shaft 26. That is, FIG. 10 shows where the driving source unit for winding the cleaning web is positioned (at the pressure increasing state) according to the fourth embodiment, and FIG. 11 shows where the driving source unit for winding the cleaning web is not positioned (at the pressure reducing state).

Fifth Embodiment

Figure 8:
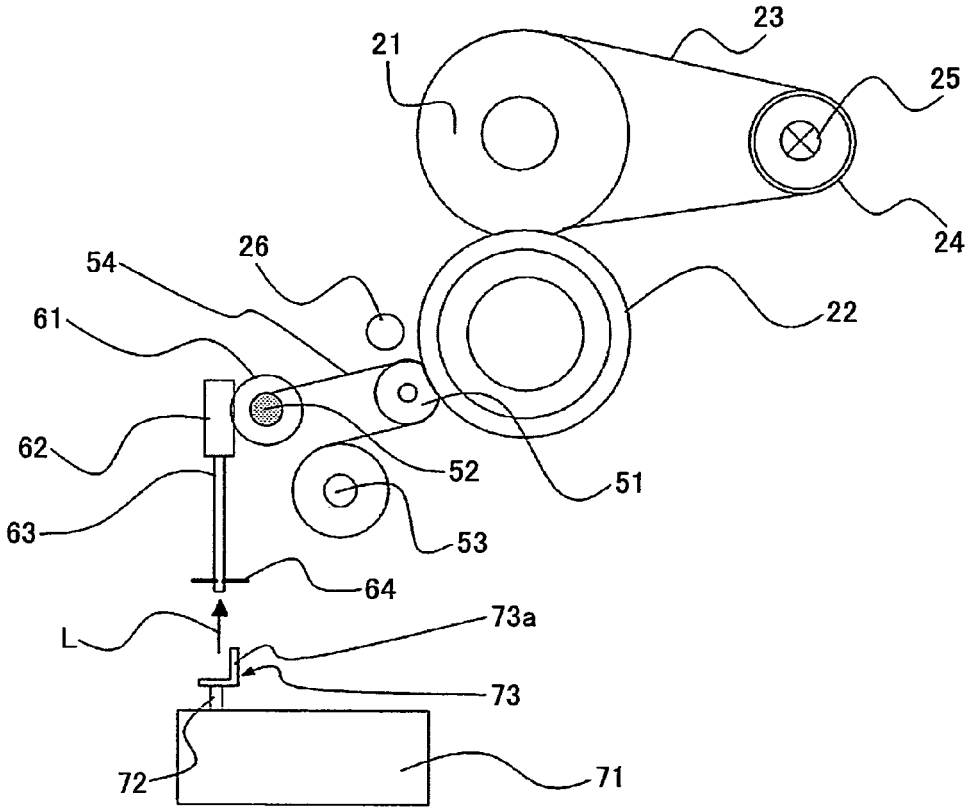
FIG. 8 is a conceptual view showing where the cleaning web unit is being detached according to the third embodiment of the present invention.
Figure 12A:
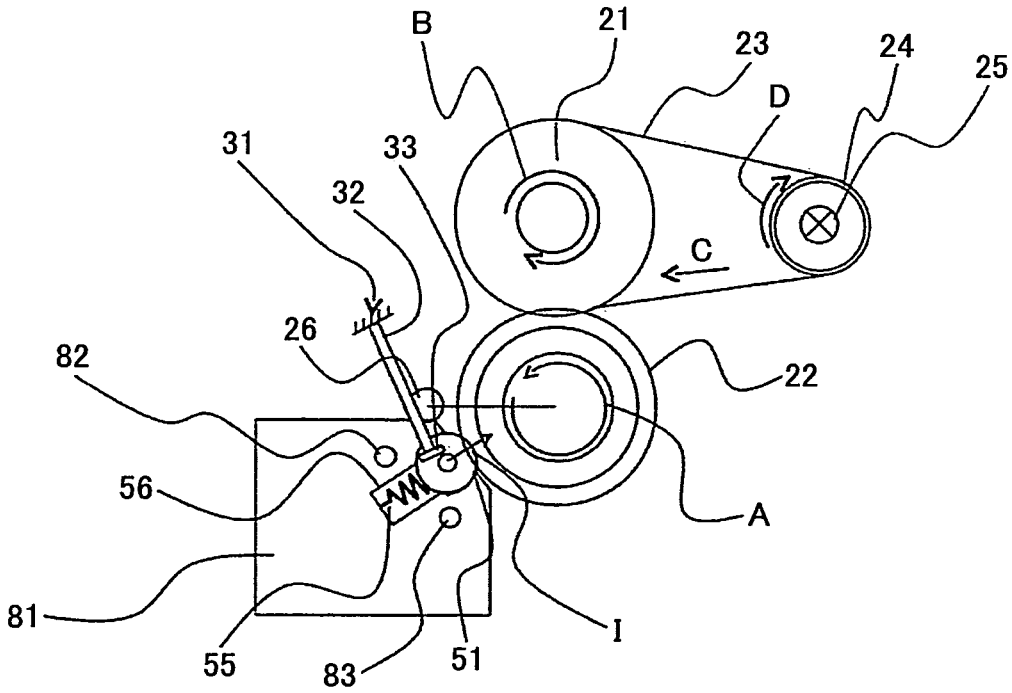
FIG. 12A is a conceptual view showing where the driving source unit for winding the cleaning web is positioned (at the pressure increasing state) according to a fifth embodiment of the present invention.
Figure 12B:
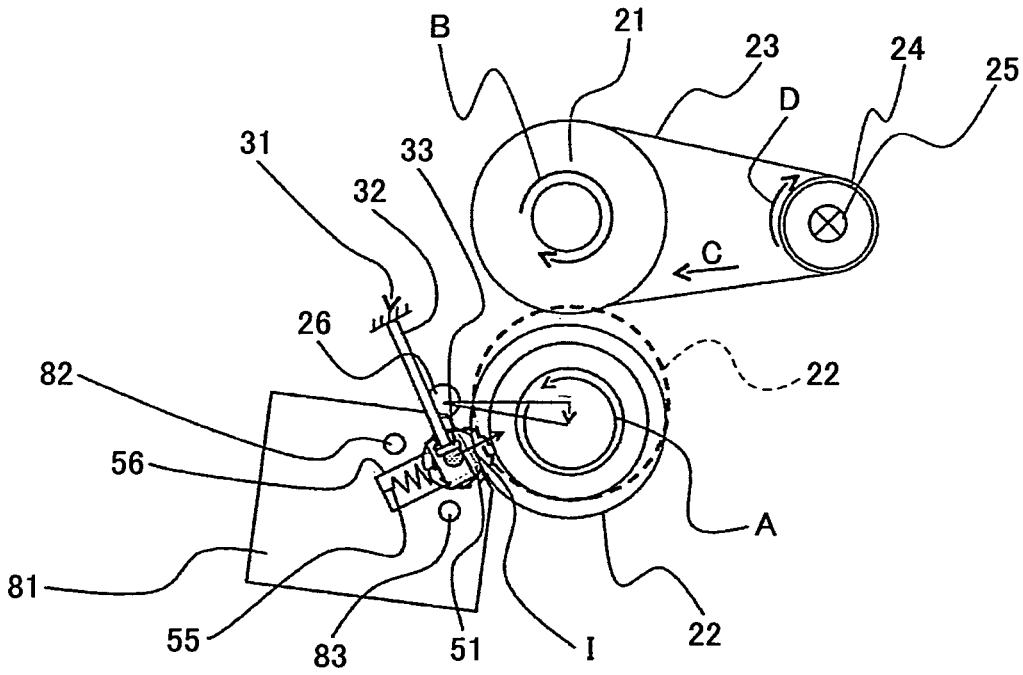
FIG. 12B is a conceptual view showing where the driving source unit for winding the cleaning web is not positioned (at the pressure reducing state) according to the fifth embodiment of the present invention.

A fifth embodiment of the present invention is shown in FIGS. 12A and 12B. This embodiment is directed to the fixing unit composed of the fixing roller 21, the pressure roller 22, the fixing belt 23, the heaters 25, the cleaning web contact roller 51, and the pressure mechanism 55. As shown in FIGS. 7 and 8, in this fixing unit, the cleaning web winding roller 52 and the cleaning web supply roller 53 at the pressure increasing state and the cleaning web winding roller 52 and the cleaning web supply roller 53 at the pressure reducing state shown are fixed in their positions with respect to the pressure roller 22 regardless of how the pressure roller 22 is arranged. This fixing unit has a mechanism similar to those, for example, shown in FIG. 6 such that the rollers move following the pressure roller 22 to maintain a constant positional relationship between the rollers and the pressure roller 22.

Further, a support member 32 that supports a friction sliding part 33 is arranged as shown in FIGS. 12A and 12B such that the friction sliding member 33 is pressed to the rotation shaft of the cleaning web contact roller 51 in a direction perpendicular to the vector as indicated by arrow I. Thus, the support member 32 is completely fixed to the fixing unit at a fixing surface 31. The friction sliding member 33 may be a plate spring formed of stainless steel or a sliding member formed of silicon rubber. Thus, when the friction sliding member 33 friction-slides with the rotation of the rotation shaft of the cleaning web contact roller 51, the perpendicular reaction force of the friction sliding member 33 acts in a direction perpendicular to the vector as indicated by arrow I exerted by the pressure mechanism 55 of the cleaning web contact roller 51. Note that when the fixing unit forms a fixing nip to fix unfixed toner on a recording medium, i.e., at the pressure increasing state, the friction sliding member 33 and the support member 32 are arranged such that the friction sliding member 33 is separated from the rotation shaft of the cleaning web contact roller 51 as shown in FIG. 12A and a friction sliding load is not applied even if the cleaning web contact roller 51 rotates.

In this embodiment, the friction sliding member 33 can apply a friction sliding load to the cleaning web contact roller 51 only when the fixing unit is in the pressure reducing state. Therefore, when a normal cleaning web winding operation is performed during the fixing of unfixed toner on a recording medium, i.e., at the pressure increasing state, the friction sliding load is not applied. As a result, it is possible to reduce a torque required for winding a cleaning web and realize the power saving of a motor as the driving source and the downsizing of the unit. Further, the cleaning web winding roller 52 and the cleaning web supply roller 53 are fixed in their positions with respect to the pressure mechanism 55 that presses the pressure roller 22 acting as the pressure member and the cleaning web contact roller 51, and move following the pressure mechanism 55. Therefore, it is possible to maintain a positional relationship between the contact part of the cleaning web, the cleaning web winding roller 52, and the cleaning web supply roller 53 and reliably collect and supply the cleaning web regardless of the position where the pressure roller 22 acting as the pressure member is arranged.

In this embodiment, even if the pressure roller 22 is driven in a direction opposite to that when a recording medium passes through, the friction sliding member 33 is brought into contact with the rotation shaft of the cleaning web contact roller 51 to apply the friction sliding load thereto. Thus, the rotation of the cleaning web contact roller 51 is stopped to prevent the cleaning web from being excessively wound from the cleaning web supply roller 53. Further, the friction sliding member 33 is brought into contact with the rotation shaft of the cleaning web contact roller 51 at an angle perpendicular to the vector of the contact force applied from the cleaning web contact roller 51 to the pressure roller 22. Therefore, it is possible to form an ensured cleaning nip without having an impact on the direction and size of the vector of the contact force and realize a constant cleaning function.

Sixth Embodiment

Figure 13A:
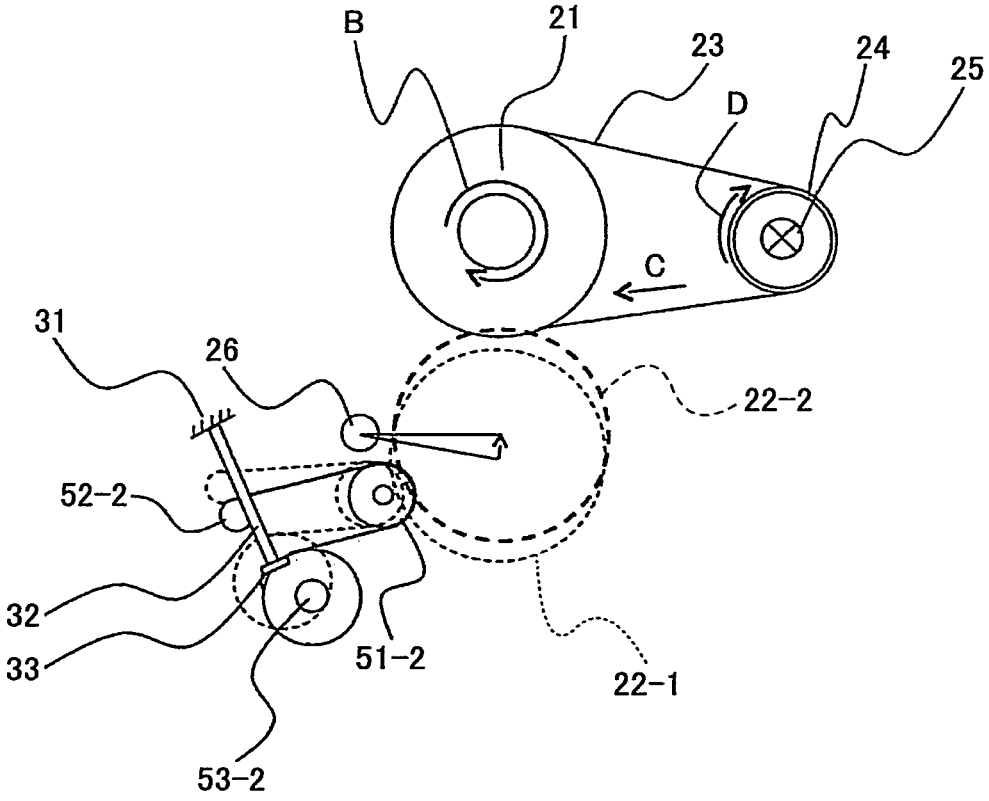
FIG. 13A is a conceptual view showing where the driving source unit for winding the cleaning web is positioned (at the pressure increasing state) according to a sixth embodiment of the present invention.
Figure 13B:
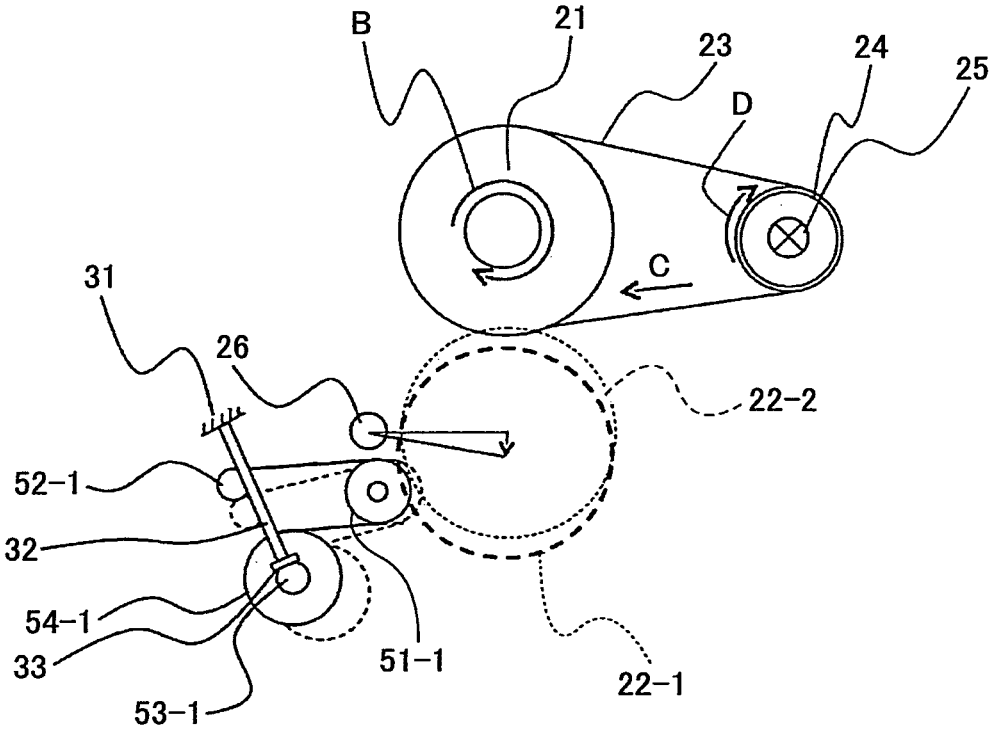
FIG. 13B is a conceptual view showing where the driving source unit for winding the cleaning web is not positioned (at the pressure reducing state) according to the sixth embodiment of the present invention.

A sixth embodiment of the present invention is shown in FIGS. 13A and 13B. This embodiment is directed to the fixing unit composed of the fixing roller 21, the pressure roller 22, the fixing belt 23, the heating roller 24, the heaters 25, the cleaning web contact roller 51, a cleaning web 54-1, and the pressure mechanism 55 as in the fifth embodiment. As shown in FIGS. 13A and 13B, in this fixing unit, a cleaning web winding roller 52-2 and a cleaning web supply roller 53-2 at the pressure increasing state shown in FIG. 13A and a cleaning web winding roller 52-1 and a cleaning web supply roller 53-1 at the pressure reducing state shown in FIG. 13B are fixed in their positions with respect to the pressure roller 22 regardless of how the pressure roller 22 is arranged. This fixing unit has a mechanism similar to that, for example, shown in FIG. 6 such that the rollers move following the pressure roller 22 to maintain a constant positional relationship between the rollers and the pressure roller 22.

Further, as in the fifth embodiment, the friction sliding member 33 and the support member 32 that supports the friction sliding member 33 are arranged as shown in FIGS. 13A and 13B. The support member 32 is completely fixed to the fixing unit at the fixing surface 31. Since the material or the like of the friction sliding member 33 is similar to that of the fifth embodiment and the cleaning web winding roller 52 and the cleaning web supply roller 53 other than the friction sliding member 33 and the support member 32 are similar to those shown in FIG. 6, their duplicated descriptions are omitted here. In the fixing unit of this embodiment, when the fixing unit forms a fixing nip to fix unfixed toner on a recording medium, i.e., at the pressure increasing state, the friction sliding member 33 and the support member 32 are arranged such that the friction sliding member 33 is separated from the rotation shaft of the cleaning web supply roller 53 as shown in FIG. 13A and a friction sliding load is not applied even if the cleaning web supply roller 53 rotates. Further, at the pressure increasing state, the friction sliding member 33 and the support member 32 are arranged such that the friction sliding member 33 is brought into contact with the rotation shaft of the cleaning web supply roller 53 to apply a friction sliding load as shown in FIG. 13B.

That is, in this embodiment, even if the pressure member is driven in a direction opposite to that when a recording medium passes through, the friction sliding member 33 is brought into contact with the rotation shaft of the cleaning web supply roller 53-1 to apply the friction sliding load. Thus, the rotation of the cleaning web supply roller 53-1 is stopped to prevent the cleaning web from being excessively wound from the cleaning web supply roller 53-1. As a result, it is possible to form an ensured cleaning nip and realize a constant cleaning function.

In any of the above embodiments, although not shown in the figures, it is preferable to cover, among those whose temperature becomes high at the operation of the unit, parts that an operator possibly touches or is highly likely to touch at replacement with a resin material or the like having high heat insulation. If some of the parts are not covered due to their structures, the parts that possibly become in high temperature may be directly subjected to hair implantation or the like to increase their heat insulation. Moreover, in the conveyance direction of a transfer sheet or the like acting as a recording medium, parts on the downstream side of the fixing units in the above embodiments are omitted in the figures, but a gloss application unit, e.g., a second fixing unit may be provided.

The present invention is not limited to the specifically disclosed embodiments, and variations and modifications may be made without departing from the scope of the present invention.

The present application is based on Japanese Priority Application Nos. 2010-062534 filed on Mar. 18, 2010 and 2010-267561 filed on Nov. 30, 2010, the entire contents of which are hereby incorporated herein by reference.

What is claimed is:

1. A fixing unit that causes a recording medium to pass through a nip part between a fixing member and a pressure member and applies heat and pressure to the recording medium to fix toner thereon, the fixing unit comprising:

the fixing member;

the pressure member brought into press-contact with a front surface of the fixing member;

a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller; wherein the contact roller of the cleaning web unit is caused to move following a movement of the pressure mechanism, and the supply roller, the winding roller, and the contact roller are supported by a first member that moves in conjunction with a second member, which is separate from the first member, supporting the pressure member to follow the movement of the pressure mechanism for increasing/reducing the pressure thereof.

2. The fixing unit according to claim 1, wherein the cleaning web unit has a unique cover.

3. An image forming apparatus comprising:

an image forming part; and the fixing unit according to claim 1; wherein a toner image formed by the image forming part is transferred and fixed onto the recording medium.

4. The fixing unit according to claim 1, wherein the first member has positioning pins and a square-hole-shaped part.

5. The fixing unit according to claim 1, wherein the second member is freely rotatable about a rotation shaft fixed inside the fixing unit, and has a hole shape for holding a journal part of the pressure member, and is shaped in a manner capable of fixing a distance between shafts of the pressure member and the rotation shaft.

6. The fixing unit according to claim 5, wherein the second member has a hole-shaped part capable of completely fixing the first member in a prescribed positional relationship between shaft lines of the respective rollers.

7. The fixing unit according to claim 1, wherein the first member holds a slide bearing which is allowed to move in a direction toward the pressure member.

8. The fixing unit according to claim 7, wherein the slide bearing is pressed to the pressure member by a spring.

9. A fixing unit that causes a recording medium to pass through a nip part between a fixing member and a pressure member and applies heat and pressure to the recording medium to fix toner thereon, the fixing unit comprising:

the fixing member;

the pressure member brought into press-contact with a front surface of the fixing member;

a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller, a driving source unit that drives the winding roller, the driving source unit being provided outside the cleaning web unit; wherein the contact roller of the cleaning web unit is caused to move following a movement of the pressure mechanism, and the cleaning web unit is singly detachable from a fixing unit main body.

10. The fixing unit according to claim 9, wherein the driving source unit has a mechanism for changing a position thereof in accordance with the positions of the cleaning web unit and the pressure member.

11. A fixing unit that causes a recording medium to pass through a nip part between a fixing member and a pressure member and applies heat and pressure to the recording medium to fix toner thereon, the fixing unit comprising:

the fixing member;

the pressure member brought into press-contact with a front surface of the fixing member;

a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller; wherein:

the contact roller of the cleaning web unit is caused to move following a movement of the pressure mechanism, the fixing member is a fixing belt formed of an endless belt, the fixing unit further includes a member that applies a perpendicular reaction force to a rotation shaft of the contact roller in a direction perpendicular to a direction in which the contact roller is brought into contact with the pressure member, and the member is capable of stopping a rotation of the contact roller.

12. The fixing unit according to claim 11, wherein the rotation of the contact roller is stopped by a friction sliding load applied when the member that applies the perpendicular reaction force slides on the rotation shaft of the contact roller, the pressure mechanism reduces the pressure to reduce or completely stop the friction sliding load due to the member that applies the perpendicular reaction force, and the friction sliding load due to the member that applies the perpendicular reaction force is applied only when the nip is not in a state where unfixed toner on the recording medium is being fixed.

13. The fixing unit according to claim 11, wherein a kinetic friction coefficient between the pressure member and the web is set to be smaller than a static friction coefficient between the web and a contact surface of the contact roller.

14. The fixing unit according to claim 11, wherein the supply roller, the winding roller, and the contact roller are supported by a member that moves in conjunction with a member supporting the pressure member to follow the movement of the pressure mechanism and maintain a prescribed positional relationship between shaft lines of the respective rollers.

15. The fixing unit according to claim 11, further comprising:

a driving source unit that drives the winding roller, the driving source unit being provided outside the cleaning web unit; wherein the cleaning web unit is singly detachable from a fixing unit main body.

16. The fixing unit according to claim 15, wherein the driving source unit has a mechanism for changing a position thereof in accordance with the positions of the cleaning web unit and the pressure member.

17. A fixing unit that causes a recording medium to pass through a nip part between a fixing member and a pressure member and applies heat and pressure to the recording medium to fix toner thereon, the fixing unit comprising:

the fixing member;

the pressure member brought into press-contact with a front surface of the fixing member;

a pressure mechanism that changes a position at which the pressure member is brought into press-contact with the fixing member, the pressure mechanism being capable of controlling a presence or absence and a width of the nip part; and a cleaning web unit having a contact roller brought into contact with at least the pressure member via a web, a supply roller that supplies a new web, and a winding roller that winds and collects the web having wiped off an attachment on the pressure roller; wherein:

the contact roller of the cleaning web unit is caused to move following a movement of the pressure mechanism, the fixing member is a fixing belt formed of an endless belt, the fixing unit further includes a member that applies a perpendicular reaction force to a rotation shaft of the supply roller in a direction perpendicular to a direction in which the supply roller is brought into contact with the pressure member, and the member is capable of stopping a rotation of the supply roller.

18. The fixing unit according to claim 17, wherein the rotation of the supply roller is stopped by a friction sliding load applied when the member that applies the perpendicular reaction force slides on the rotation shaft of the supply roller, the pressure mechanism reduces the pressure to reduce or completely stop the friction sliding load due to the member that applies the perpendicular reaction force, and the friction sliding load due to the member that applies the perpendicular reaction force is applied only when the nip is not in a state where unfixed toner on the recording medium is being fixed.

19. The fixing unit according to claim 17, wherein the winding roller moves following the movement of the pressure mechanism of the pressure member together with the supply roller and the contact roller, the winding roller being supported by a member that moves in conjunction with a member supporting the pressure member to maintain a prescribed positional relationship between shafts of the respective rollers in a cross section including a direction in which the perpendicular reaction force is applied.

20. The fixing unit according to claim 17, further comprising:

a driving source unit that drives the winding roller, the driving source unit being provided outside the cleaning web unit; wherein the cleaning web unit is singly detachable from a fixing unit main body.

21. The fixing unit according to claim 20, wherein the driving source unit has a mechanism for changing a position thereof in accordance with the positions of the cleaning web unit and the pressure member.

* * * * *